US007681544B2

(12) United States Patent
Reed

(10) Patent No.: US 7,681,544 B2
(45) Date of Patent: Mar. 23, 2010

(54) CONTROL DEVICE FOR ENGINE OF POWER EQUIPMENT APPARATUS

(75) Inventor: Camas Reed, Columbus, OH (US)

(73) Assignee: Honda Motor Company, Ltd., Tokyo (JP)

( * ) Notice: Subject to any disclaimer, the term of this patent is extended or adjusted under 35 U.S.C. 154(b) by 397 days.

(21) Appl. No.: 11/810,747

(22) Filed: Jun. 7, 2007

(65) Prior Publication Data

US 2008/0302325 A1 Dec. 11, 2008

(51) Int. Cl.

| | |
|---|---|
| ***F02M 1/00*** | (2006.01) |
| ***F02M 37/00*** | (2006.01) |
| *F02D 33/00* | (2006.01) |
| *F23K 5/00* | (2006.01) |

(52) U.S. Cl. ..... 123/179.18; 123/330; 180/335

(58) Field of Classification Search ..... 123/330, 123/198 R, 179.18; 74/826, 471 R, 490.12, 74/503; 137/590, 592, 636.4; 180/335; 126/39 G; 251/294, 304, 309–314

See application file for complete search history.

(56) References Cited

U.S. PATENT DOCUMENTS

| | | | | |
|---|---|---|---|---|
| 1,833,982 | A * | 12/1931 | Weatherhead, Jr. | 180/335 |
| 2,136,500 | A * | 11/1938 | Griese et al. | 74/502 |
| 3,511,220 | A * | 5/1970 | Otterbach et al. | 123/198 R |
| 4,226,814 | A | 10/1980 | Dirda | |
| 4,304,737 | A | 12/1981 | Breckenfeld et al. | |
| 4,319,664 | A * | 3/1982 | Price et al. | 184/1.5 |
| 4,455,266 | A | 6/1984 | Gerhardy | |
| 4,462,945 | A | 7/1984 | Brown | |
| 4,895,114 | A | 1/1990 | Iida et al. | |
| 5,115,837 | A * | 5/1992 | Tupper | 137/625.41 |
| 5,291,870 | A | 3/1994 | Covey, Jr. | |
| 5,836,214 | A * | 11/1998 | Marquis | 74/558.5 |
| 6,082,323 | A | 7/2000 | Winberg | |
| 6,213,083 | B1 | 4/2001 | Winberg | |
| 6,257,179 | B1 | 7/2001 | Uenoyama et al. | |
| 6,408,805 | B2 | 6/2002 | Uenoyama et al. | |
| 6,484,746 | B2 * | 11/2002 | Tine, Jr. | 137/351 |
| 6,516,779 | B2 | 2/2003 | Ikeda | |
| 6,564,761 | B2 | 5/2003 | Uenoyama et al. | |
| 6,729,276 | B2 | 5/2004 | Uenoyama et al. | |
| 6,848,417 | B2 | 2/2005 | Surnilla et al. | |
| 6,857,410 | B2 | 2/2005 | Davis et al. | |
| 6,871,623 | B2 | 3/2005 | Ohsawa et al. | |

(Continued)

FOREIGN PATENT DOCUMENTS

JP 57206743 A * 12/1982

*Primary Examiner*—Stephen K Cronin
*Assistant Examiner*—Arnold Castro
(74) *Attorney, Agent, or Firm*—Ulmer & Berne LLP

(57) ABSTRACT

A control device is configured for use with an engine of a power equipment apparatus. The control device includes a base, a first knob, and a second knob. The first knob is positioned adjacent to the base and is rotatable about an axis with respect to the base while being substantially restrained from axial movement along the axis with respect to the base. The first knob has an aperture surrounding and extending along the axis to define a passageway extending through the first knob. The second knob has an end portion slidingly received within the aperture of the first knob such that the second knob is axially movable along the axis with respect to the base and the first knob. Power equipment apparatus and saddle-type vehicles including control devices are also provided.

21 Claims, 9 Drawing Sheets

U.S. PATENT DOCUMENTS

| | | | | |
|---|---|---|---|---|
| 6,883,501 | B2 | 4/2005 | Chatfield et al. | |
| 6,889,489 | B2 | 5/2005 | Fackrell et al. | |
| 2001/0023711 | A1 * | 9/2001 | Gnudi | 137/590 |
| 2004/0025817 | A1 | 2/2004 | Uenoyama et al. | |
| 2005/0155581 | A1 | 7/2005 | Wells et al. | |
| 2005/0166977 | A1 * | 8/2005 | Gregory | 137/625.41 |
| 2009/0051054 | A1 * | 2/2009 | Yamazaki | 261/36.2 |
| 2009/0198316 | A1 * | 8/2009 | Laske et al. | 623/1.11 |

* cited by examiner

CONTROL DEVICE FOR ENGINE OF POWER EQUIPMENT APPARATUS

TECHNICAL FIELD

The present invention relates to a control device which is configured for use with an engine of a power equipment apparatus. In one particular embodiment, the control device has a first knob configured to selectively facilitate the flow of fuel from a fuel tank to the engine, and a second knob operable to selectively facilitate choking of the engine.

BACKGROUND OF THE INVENTION

Some conventional power equipment apparatus include separate control devices to facilitate an operator's control of fuel and choke functions for an engine. For example, a conventional all terrain vehicle ("ATV") includes a fuel knob which is configured to control the flow of fuel from a fuel tank to an engine, and which can be rotated by an operator between an "Off" position, an "On" position, and a "Reserve" position. One conventional fuel knob is generally depicted in FIGS. 9A-9B. The fuel knob 130 includes a knob 134 and a base 132 and is coupled with a fuel tank and an engine such that the knob 134 can selectively facilitate the flow of fuel from the fuel tank to the engine. The base 132 includes apertures 138 for passage of bolts for attachment of the fuel knob 130 to the fuel tank.

The fuel knob 130 receives fuel from a non-reserve portion of the fuel tank via a passageway 141 in an inlet tube 140, and receives fuel from a reserve portion of the fuel tank via a passageway 153 defined by an opening 152 in the base 132. The knob 134 includes a knob member 164 and a valve member 166. The knob member 164 includes a grip portion 170 and an aperture 147. A bolt 199 is insertable through the aperture 147 and into a threaded aperture 148 in a stem 171 of the valve member 166 to facilitate attachment of the knob member 164 to the valve member 166. After positioning the valve member 166 adjacent to the base 132 such that a bottom surface 169 of the valve member 166 is adjacent to some portion of the base 132, a cover 165 is attached to the base 132 with bolts 198 inserted through apertures 197 in the cover 165 and into threaded apertures 195 in the base 132. As assembled, an O-ring (not shown) interfaces a channel disposed about the periphery of the valve member 166 to provide a seal with respect to the base 132. The base 132 and/or cover 165 can interact with the knob 134 to limit its range of rotation with respect to the base 132.

The base 132 cooperates with the knob 134 to selectively define a conduit to facilitate the flow of fuel. In particular, the bottom surface 169 of the valve member 166 is substantially flat except that it includes a channel 168 formed as an indentation into the bottom surface 169. The base 132 includes passageways 158, 160 and 162 to facilitate the selective flow of fuel. The passageway 158 is connected with the passageway 153, the passageway 160 is connected with a passageway 151 in an outlet port 150 of the base 132, and the passageway 162 is coupled with the passageway 141. Depending upon the rotational position of the knob 134 with respect to the base 132, the channel 168 in the valve member 166 either (1) does not overlap the passageway 160 and thus prevents fuel from flowing from the fuel knob 130; (2) is positionally located over passageways 160 and 162 such that non-reserve fuel enters the inlet tube 140 and passes from the fuel knob 130 through the passageway 151; and (3) is positionally located over passageways 158 and 160 such that reserve fuel flows into the passageway 153 and passes from the fuel knob 130 through the passageway 151.

A conventional ATV also includes a choke knob which is disposed upon the ATV at a location remote from that of the fuel knob 130. An example of a conventional choke knob 230 is depicted in FIG. 9C to include a knob 236 and a base 232, wherein the knob 236 is attached to a flexible cable 244 which is routed through a sheath 246. The knob 236 has a grip portion 272 which can be gripped by an operator and moved axially inwardly and outwardly with respect to the base 232 to adjust the amount of air provided to the carburetor of the engine. In particular, an operator can pull the knob 236 outwardly to cause a reduction in the amount of air flow to the carburetor (e.g., when starting a cold engine), and can push the knob 236 inwardly to cause restoration of the flow of air to the carburetor (e.g., during normal operation of a heated engine).

By disposing the choke knob 230 remotely from the fuel knob 130 upon the ATV, separate mounting provisions are required for each knob, and separate steps must be taken during assembly of the ATV to effect attachment of each knob. Also, the provision of separate knobs upon the ATV results in increased bulk upon the ATV, and renders it difficult for an operator of the ATV to easily locate and/or simultaneously adjust both knobs.

SUMMARY OF THE INVENTION

In accordance with one embodiment of the present invention, a control device is configured for use with an engine of a power equipment apparatus. The control device comprises a base, a first knob, and a second knob. The first knob is positioned adjacent to the base and is rotatable about an axis with respect to the base while being substantially restrained from axial movement along the axis with respect to the base. The first knob comprises an aperture surrounding and extending along the axis to define a passageway extending through the first knob. The first knob is configured to selectively facilitate the flow of fuel to an engine. The second knob has an end portion which is slidingly received within the aperture of the first knob such that the second knob is axially movable along the axis with respect to the base and the first knob. The second knob is operable to selectively facilitate choking of an engine.

In accordance with another embodiment of the present invention, a power equipment apparatus comprises an engine, a fuel tank, and a control device. The control device comprises a base, a first knob, and a second knob. The first knob is positioned adjacent to the base and is rotatable about an axis with respect to the base while being substantially restrained from axial movement along the axis with respect to the base. The first knob comprises an aperture surrounding and extending along the axis to define a passageway extending through the first knob. The second knob has an end portion which is slidingly received within the aperture of the first knob such that the second knob is axially movable along the axis with respect to the base and the first knob. The control device is coupled with each of the fuel tank and the engine such that the first knob is configured to selectively facilitate the flow of fuel from the fuel tank to the engine and such that the second knob is operable to selectively facilitate choking of the engine.

In accordance with yet another embodiment of the present invention, a saddle-type vehicle comprises a frame, a seat, a handlebar, and a control device. The seat is supported with respect to the frame and is configured to support an operator in use of the saddle-type vehicle. The handlebar is supported with respect to the frame and is configured to facilitate steering of the saddle-type vehicle by an operator. The control device is supported with respect to the frame and comprises a base, a first knob, and a second knob. The first knob is positioned adjacent to the base and is rotatable about an axis with respect to the base while being substantially restrained from axial movement along the axis with respect to the base. The first knob comprises an aperture surrounding and extending along the axis to define a passageway extending through the first knob. The second knob has an end portion which is slidingly received within the aperture of the first knob such that the second knob is axially movable along the axis with respect to the base and the first knob.

BRIEF DESCRIPTION OF THE DRAWINGS

While the specification concludes with claims particularly pointing out and distinctly claiming the present invention, it is believed that the same will be better understood from the following description taken in conjunction with the accompanying drawings in which:

DETAILED DESCRIPTION OF EMBODIMENTS

Embodiments of the present invention and its operation are hereinafter described in detail in connection with the views and examples of FIGS. 1-7 and 8A-8F, wherein like numbers indicate the same or corresponding elements throughout the views. A control device in accordance with one embodiment of the present invention can be provided as a component of any of a variety of a power equipment apparatus. Such power equipment apparatus can include, for example, vehicles, tools, and other machinery. Examples of such vehicles can include automobiles, trucks, vans, aircraft, boats, scooters, agricultural equipment, construction equipment, toys, and saddle-type vehicles. Examples of saddle-type vehicles include, for example, ATV's, motorcycles, snowmobiles, and personal watercraft.

Figure 1:
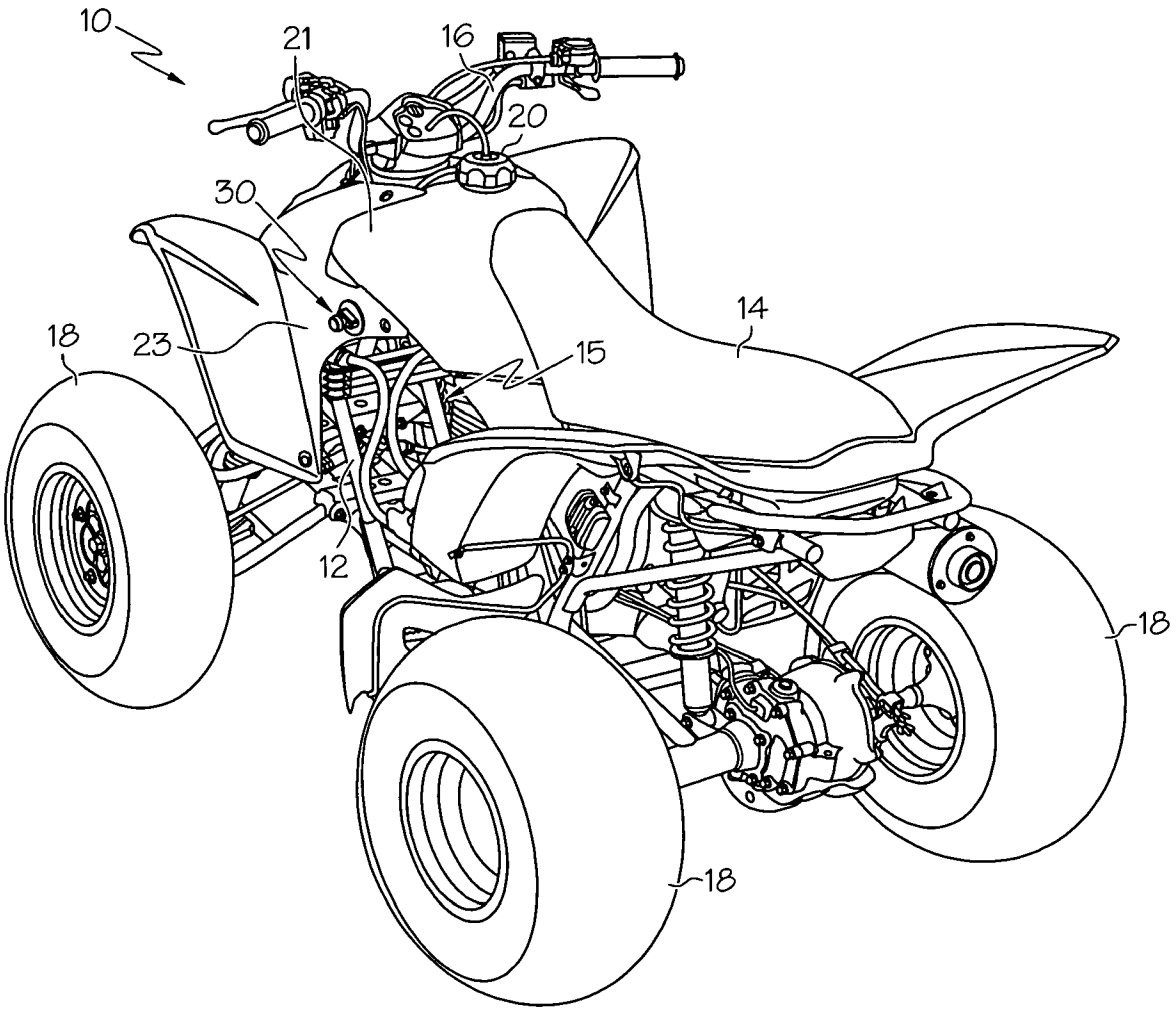
FIG. 1 is perspective view depicting an ATV having a control device in accordance with one embodiment of the present invention.

A control device 30 can be provided upon an ATV 10 as shown, for example, in FIG. 1. The ATV 10 is shown to include a seat 14 supported with respect to a frame 12. The seat 14 is configured to support an operator in use the ATV 10. The ATV 10 is also shown to include a handlebar 16 supported with respect to the frame 12. The handlebar 16 is configured to facilitate steering of the ATV 10 by an operator of the ATV 10. In addition, the ATV 10 includes an engine 15 which is also supported with respect to the frame 12 of the ATV 10. The engine 15 can comprise an internal combustion engine which is configured to selectively provide energy for rotation of wheels 18 which are rotatably supported with respect to the frame 12 of the ATV 10.

The ATV 10 can also include a fuel tank (22, shown in FIG. 2) having a fuel cap 20. In use, an operator of the ATV 10 can remove the fuel cap 20 for refueling of the fuel tank 22. In one particular embodiment, as shown in FIG. 1, for example, the fuel tank 22 can be disposed at a location beneath a body panel 21 of the ATV 10. However, in an alternative embodiment, a fuel tank can be integrated with a body panel (e.g., body panel 21) and/or disposed elsewhere upon an ATV.

The ATV 10 is also shown in FIG. 1 to include a control device 30 which protrudes and/or is otherwise accessible via an aperture in another body panel 23. However, it will be appreciated that a control device can be positioned in any of a variety of alternative locations upon an ATV or other power equipment apparatus in accordance with the teachings of the present invention. As discussed in further detail below, the control device 30 can be coupled with each of a fuel tank (e.g., 22 in FIG. 2) and an engine (e.g., 15 in FIG. 1) such that a first knob (e.g., 34 in FIG. 2) of the control device 30 can be configured to selectively facilitate the flow of fuel from the fuel tank to the engine, and such that a second knob (e.g., 36 in FIG. 2) of the control device 30 can be operable to selectively facilitate choking of the engine. As such, the control device 30 can be configured for use by an operator of the ATV 10 to selectively facilitate the flow of fuel from the fuel tank to the engine, and to furthermore selectively facilitate choking of the engine.

Choking of the engine 15 can involve limiting the amount of air provided to the carburetor(s) of the engine 15, such as when starting the engine 15 when the engine 15 is cold or unheated. Once the engine 15 is or has heated, the choking can cease, thereby allowing full air flow to the carburetor of the engine 15. It will be appreciated that a control device in accordance with other embodiments of the present invention might not be configured to facilitate control of fuel supply and/or choking of an engine, but might rather be configured or adapted to control other aspects of the engine and/or functions or features of a power equipment apparatus.

Figure 2:
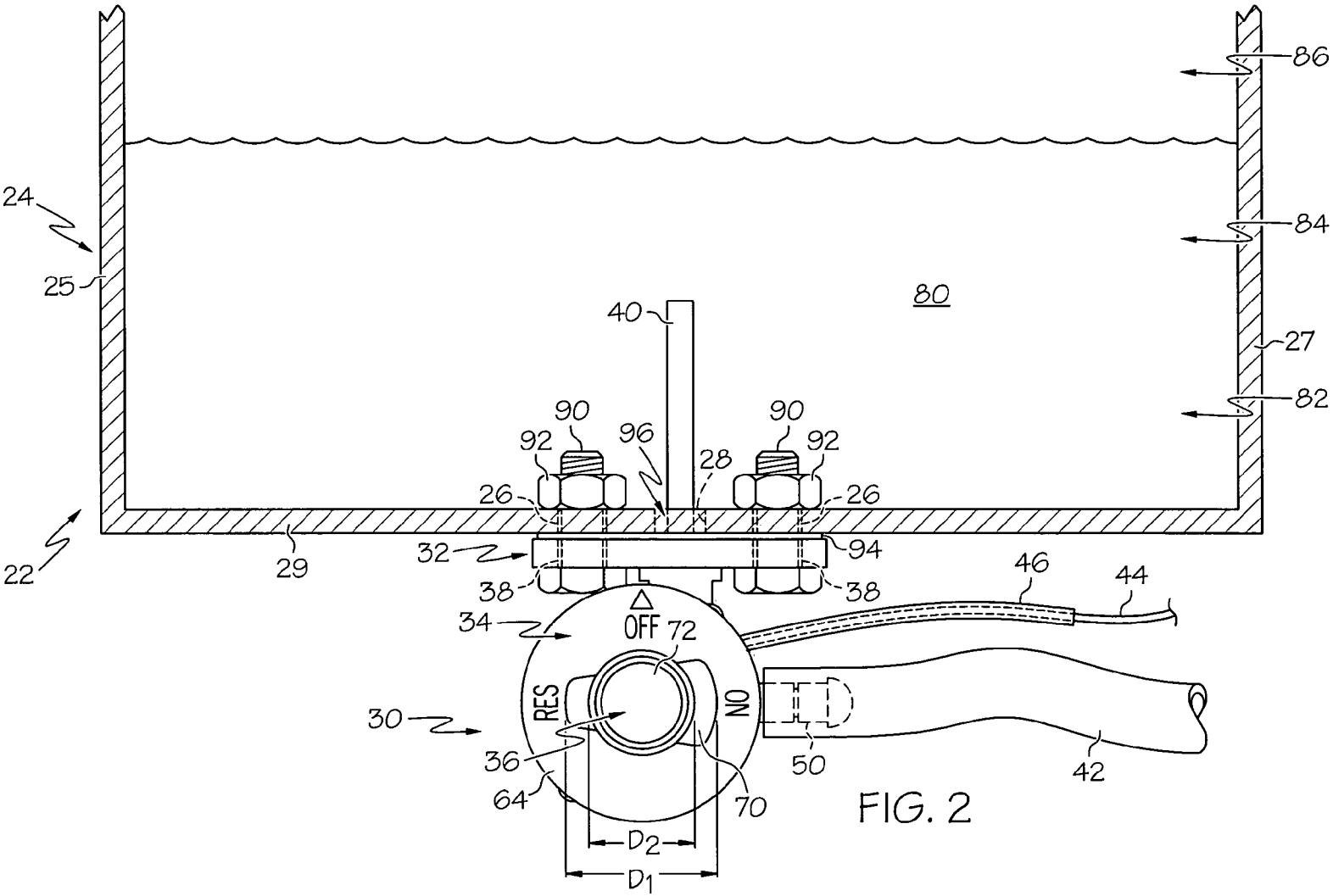
FIG. 2 is a front partial sectional view depicting the control device and other components of the ATV of FIG. 1.

Referring now to FIG. 2, the control device 30 is shown in association with a fuel tank 22, such as might be provided upon a power equipment apparatus such as the ATV 10 of FIG. 1. The fuel tank 22 is shown to comprise a wall structure 24 defining a chamber 86 for storage of fuel 80. The fuel 80 can comprise gasoline, diesel fuel, oil, alcohol, jet fuel, kerosene, and/or any of the variety of other substances or combinations thereof. While the wall structure 24 is shown to comprise generally vertically-oriented side walls 25 and 27 and a generally horizontally-oriented bottom wall 29, it will be appreciated that alternative fuel tanks in accordance with embodiments of the present invention may have wall structures having any of a variety of different configurations as will be appreciated by those skilled in the art. Additionally, it will be appreciated that the wall structure 24 of the fuel tank 22 can also include a top member or wall (not shown) for connecting the side walls 25 and 27, for interfacing the fuel cap 20, and/or for additionally preventing fuel 80 from being spilled from the fuel tank 22.

The control device 30 is shown to be attached to the bottom wall 29 of the fuel tank 22 through use of bolts 90. In particular, the control device 30 is shown to include a base 32 which includes apertures 38 for passage of the bolts 90 through a gasket 94, through apertures 26 in the bottom wall 29 of the fuel tank 22, and into respective nuts 92. By tightening of the nuts 92 upon the bolts 90, it will be appreciated that the base 32 of the control device 30 can be secured with respect to the wall structure 24 of the fuel tank 22. The gasket 94 can assist in providing a sealed connection between the wall structure 24 and the base 32, to thereby prevent fuel 80 from escaping. In alternative embodiments of the present invention, it will be appreciated that a connection between a control device and a fuel tank can be achieved without a gasket, with fasteners other than bolts, and/or in any of a variety of other configurations. For example, in one particular alternative configuration, a control device can be fastened with adhesive to a fuel tank. In another embodiment of the present invention, a base of a control device can be provided integrally with the wall structure of a fuel tank, thereby even further reducing the likelihood of encountering fuel leakage.

The control device 30 is shown to include an inlet tube 40 which, when the control device 30 is attached to the fuel tank 22 as shown in FIG. 2, extends through an aperture 28 in the bottom wall 29 of the fuel tank 22. The inlet tube 40 is configured to receive fuel 80 from a non-reserve portion 84 of the chamber 86 of the fuel tank 22. However, once the level of fuel 80 within the chamber 86 has diminished beneath the upper end of the inlet tube 40, the inlet tube 40 is typically unable to receive any fuel 80 from the chamber 86 until such time as additional fuel 80 is added to the fuel tank 22 by an operator of the ATV 10. Fuel 80 within a reserve portion 82 of the chamber 86 of the fuel tank 22 is, however, always accessible to the control device 30, not by way of the inlet tube 40, but by way of a passageway 96 provided by the aperture 28 in the bottom wall 29 of the wall structure 24 and generally annularly surrounding the inlet tube 40.

The control device 30 is shown to comprise a first knob 34 and a second knob 36, as shown in FIG. 2 and in further detail in FIGS. 3-7. The first knob 34 can be positioned adjacent to the base 32 and can be rotatable about an axis A with respect to the base 32 while being substantially restrained from axial movement along the axis A with respect to the base 32 (e.g., by a cover 65). The first knob 34 is shown to comprise a knob member 64 and a valve member 66. The knob member 64 is generally configured for interaction with an operator of the ATV 10, wherein the valve member 66 is generally configured for interaction with the base 32 of the control device 30. While the knob member 64 and the valve member 66 are shown to be provided as separate components which are attached together to form the first knob 34, it will be appreciated that a first knob in accordance with the teachings of the present invention can alternatively be formed as a single integral component, or from more than two separate components. The knob member 64 can be provided with a grip portion 70 which is configured for grasping by an operator of the ATV 10 to facilitate rotation of the first knob 34 with respect to the base 32 by the operator of the ATV 10. The first knob 34 also comprises an aperture (e.g., shown in FIG. 5 to be provided by cooperation of apertures 47 and 48) which surround and extend along the axis A to define a passageway 49 extending through the first knob 34.

Figure 3:
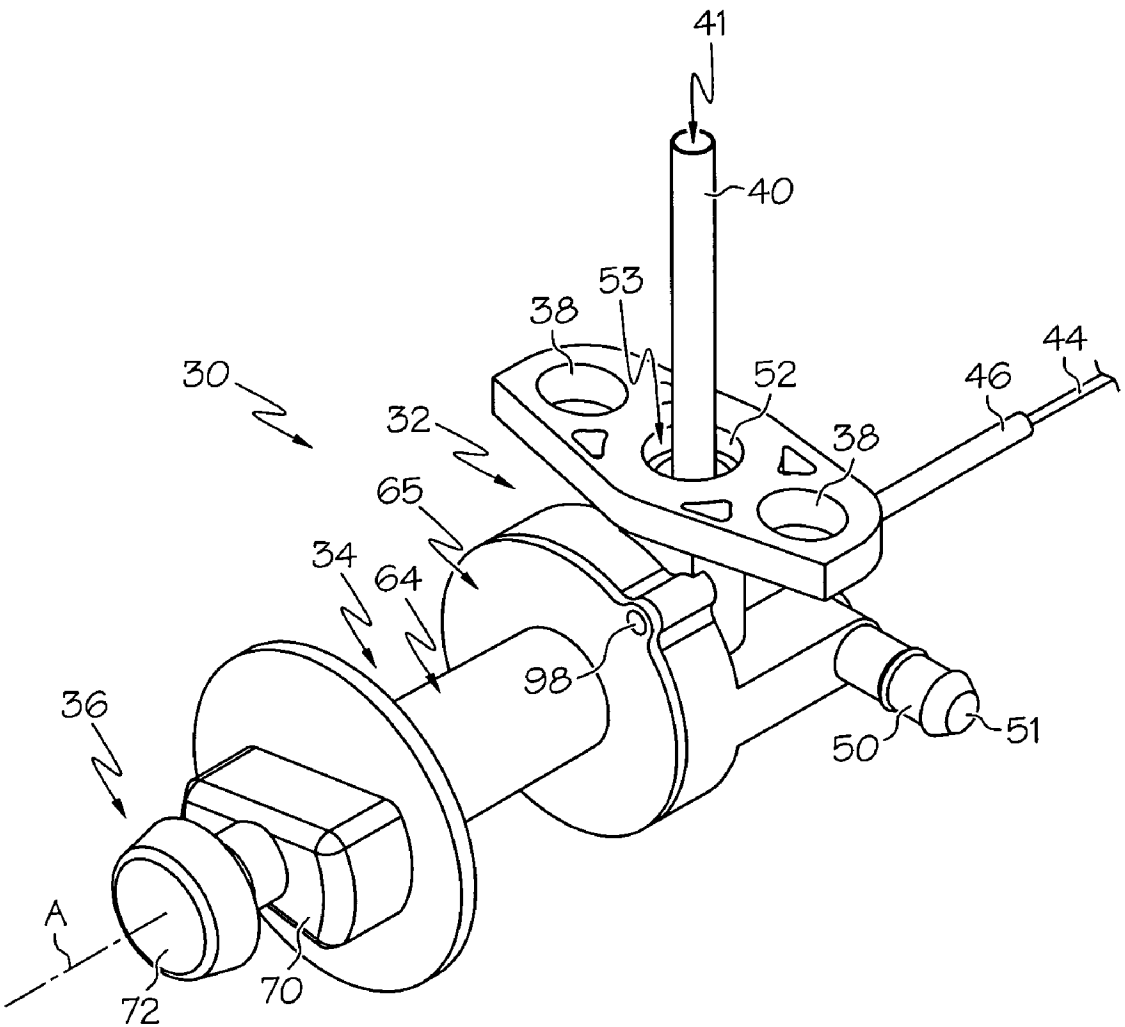
FIG. 3 is a front perspective view depicting the control device of FIG. 2 apart from the other components of the ATV, wherein the second knob of the control device is depicted as being disposed in an inward position.
Figure 4:
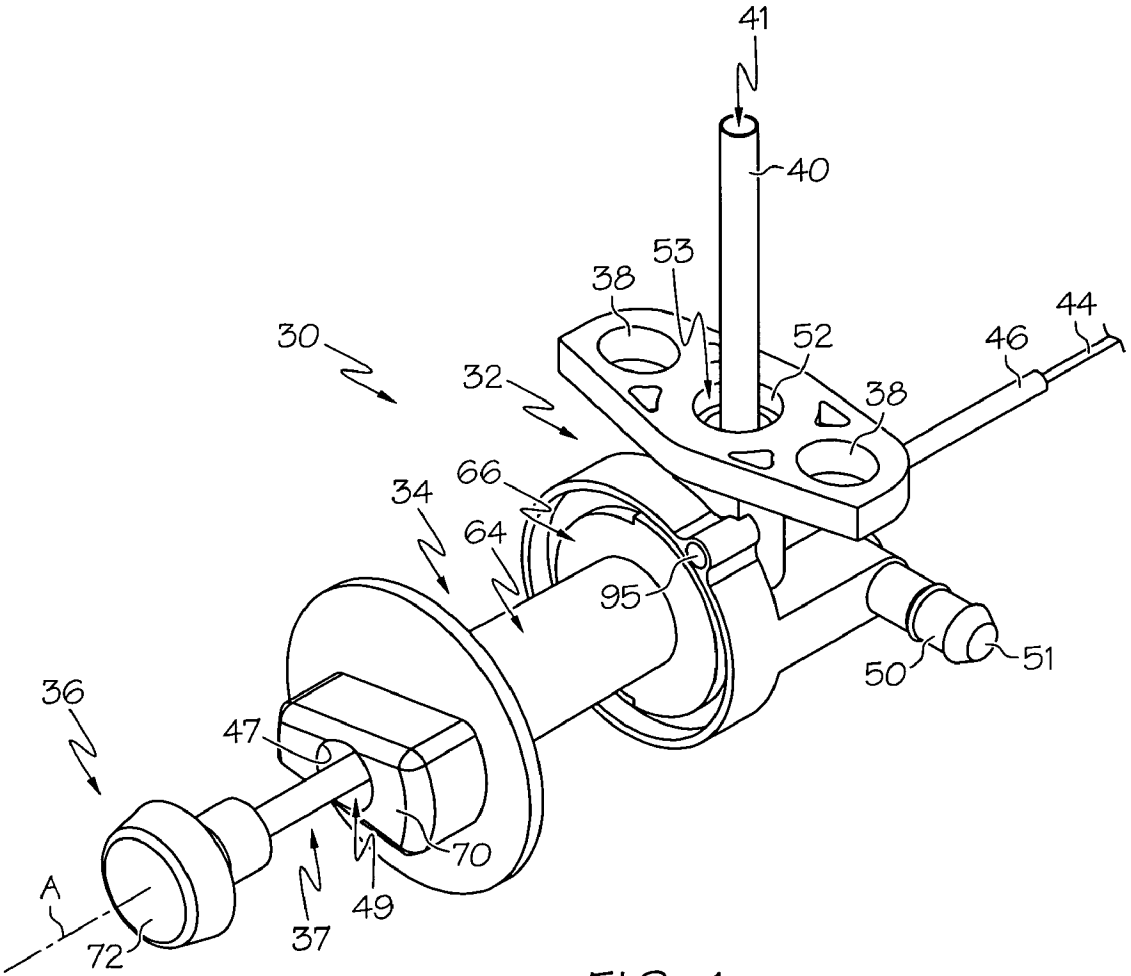
FIG. 4 is a front perspective view depicting the control device of FIG. 3, wherein the second knob of the control device is depicted as being disposed in an outward position, and wherein a cover of the base has been removed for clarity of illustration.

The second knob 36 is shown to have an end portion 37, and a flexible cable 44 can be attached to the end portion 37. The end portion 37 of the second knob 36 can be slidingly received within an aperture (e.g., shown in FIG. 5 to be provided by cooperation of apertures 47 and 48) in the first knob 34 such that the second knob 36 is axially movable along the axis A with respect to the base 32 and the first knob 34. In one particular embodiment of the present invention, wherein the second knob 36 is operable to selectively facilitate choking of the engine 15, an operator of the ATV 10 can cause choking of the engine 15 by pulling the second knob 36 outwardly from the base 32 and the first knob 34 along the axis A, as shown in FIG. 4. By pulling the second knob 36 outwardly in this manner, the flexible cable 44 can be drawn toward the base 32 and through a sheath 46, and can accordingly interact with a choke mechanism within or associated with the engine 15 for causing choking of the engine 15. When desired by an operator of the ATV 10, such as upon starting of the engine 15, the operator can cease choking the engine 15 by depressing the second knob 36 with respect to both the base 32 and the first knob 34, as shown in FIG. 3. Depressing the second knob 36 in this manner can cause movement of the flexible cable 44 within the sheath of 46 in a direction away from the base 32, and resultant cessation of choking of the engine 15.

The second knob 36 can have a grip portion 72 which is configured for grasping by an operator of the ATV 10 to facilitate axial movement of the second knob 36 with respect to the base 32 and the first knob 34. As shown in FIG. 2, the grip portion 70 of the first knob 34 has a first outer diameter $D_1$, and the grip portion 72 of the second knob 36 has a second outer diameter $D_2$. In one embodiment of the present invention, the first outer diameter $D_1$ is larger than the second outer diameter $D_2$. It will be appreciated that such a configuration can enable an operator to easily manipulate one or both of the first knob 34 and the second knob 36 through use of only a single hand. However, it will be appreciated that a control device in accordance with other embodiments of the present invention can include first and second knobs having grip portions with alternative relative dimensional relationships.

Figure 8A:
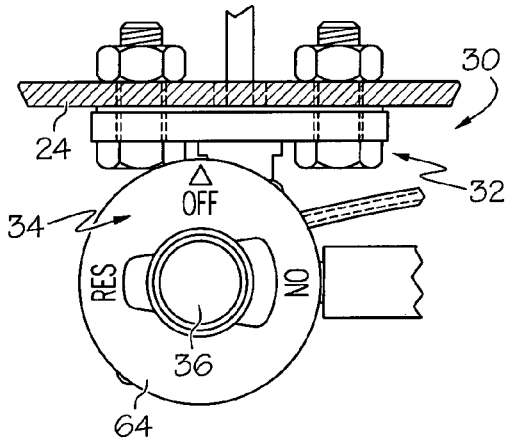
FIG. 8A is a front partial sectional view depicting the control device and certain other components of FIG. 2, wherein the first knob is in a first position.
Figure 8B:
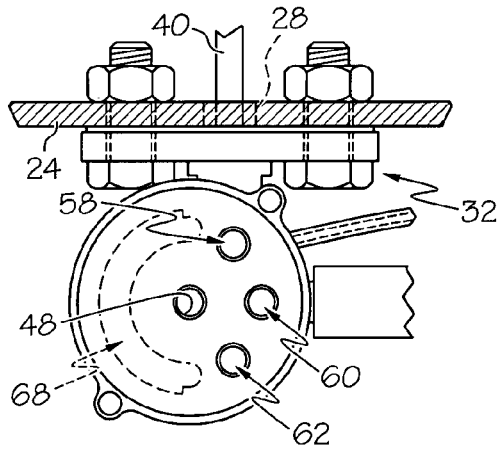
FIG. 8B is a front partial sectional view depicting the base of the control device and certain other components of FIG. 8A, wherein the relative position of the channel of the first knob is illustrated in dashed lines.
Figure 8C:
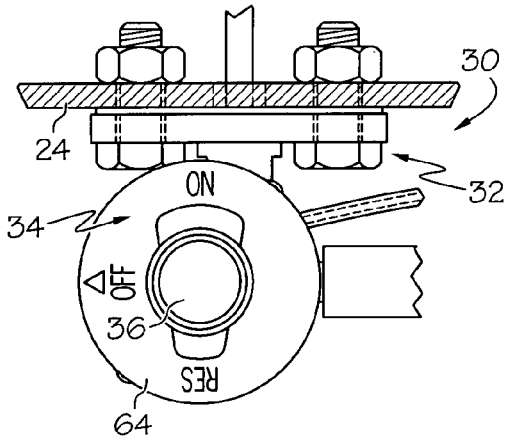
FIG. 8C is a front partial sectional view depicting the control device and certain other components of FIG. 2, wherein the first knob is in a second position.
Figure 8D:
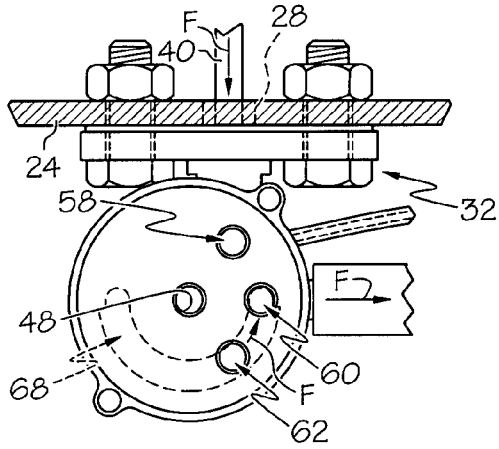
FIG. 8D is a front partial sectional view depicting the base of the control device and certain other components of FIG. 8C, wherein the relative position of the channel of the first knob is illustrated in dashed lines.
Figure 8E:
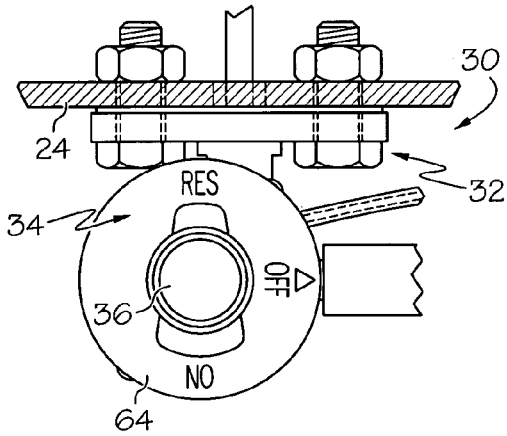
FIG. 8E is a front partial sectional view depicting the control device and certain other components of FIG. 2, wherein the first knob is in a third position.

The first knob 34 can be rotatable among a first position (shown FIG. 8A), a second position (shown in FIG. 8C), and a third position (shown in FIG. 8E). When the first knob 34 is in the first position, as shown in FIG. 8A, the control device 30 can be configured to prohibit the flow of fuel from the fuel tank 22 to the engine 15. When the first knob 34 is in the second position, as shown in FIG. 8C, the control device 30 can be configured to facilitate the flow of fuel from a first fuel source to the engine 15. The first fuel source can, as shown in FIG. 2, comprise the non-reserve portion 84 of the chamber 86 of the fuel tank 22. Accordingly, in the particular embodiment depicted in FIG. 2, when the first knob 34 is in the second position, fuel 80 from the non-reserve portion 84 of the chamber 86 passes into the inlet tube 40, through the control device 30, from a passageway 51 in the outlet port 50 of the control device 30, and into a fuel line 42 leading to the engine 15 of the ATV 10.

When the first knob 34 is in the third position, as shown in FIG. 8E, the control device 30 is configured to facilitate the flow of fuel from a second fuel source to the engine 15. In one particular embodiment, the second fuel source can comprise the reserve portion 82 of the chamber 86 of the fuel tank 22. As such, when the first knob 34 is in the third position, fuel 80 from the reserve portion 82 of the chamber 86 can flow into the passageway 96, through the control device 30, from the passageway 51 in the outlet port 50 of the control device 30, and into the fuel line 42 leading to the engine 15 of the ATV 10.

Figure 7:
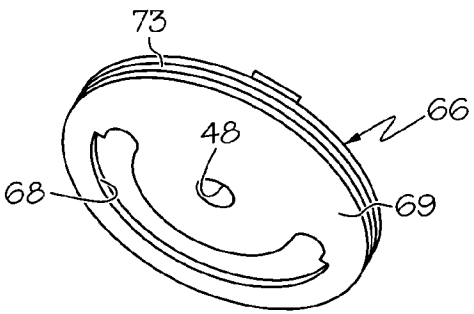
FIG. 7 is a rear perspective view depicting a portion of the first knob of the control device of FIG. 5.
Figure 6:
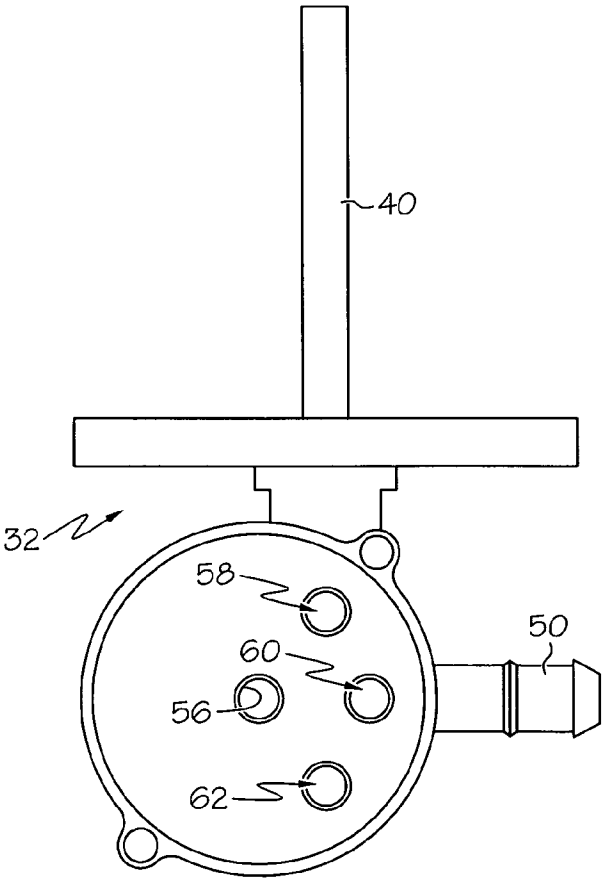
FIG. 6 is a front elevational view depicting the base of the control device of FIG. 5.
Figure 8F:
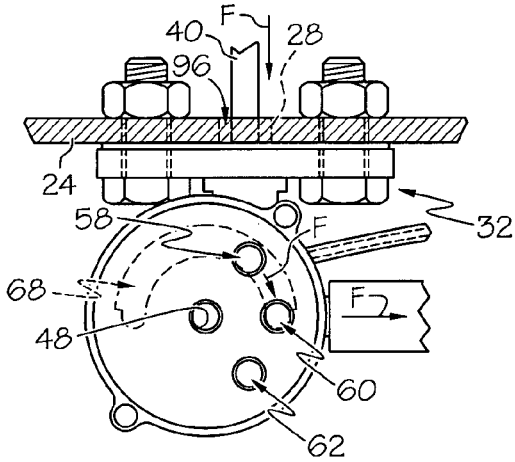
FIG. 8F is a front partial sectional view depicting the base of the control device and certain other components of FIG. 8E, wherein the relative position of the channel of the first knob is illustrated in dashed lines.
Figure 9A:
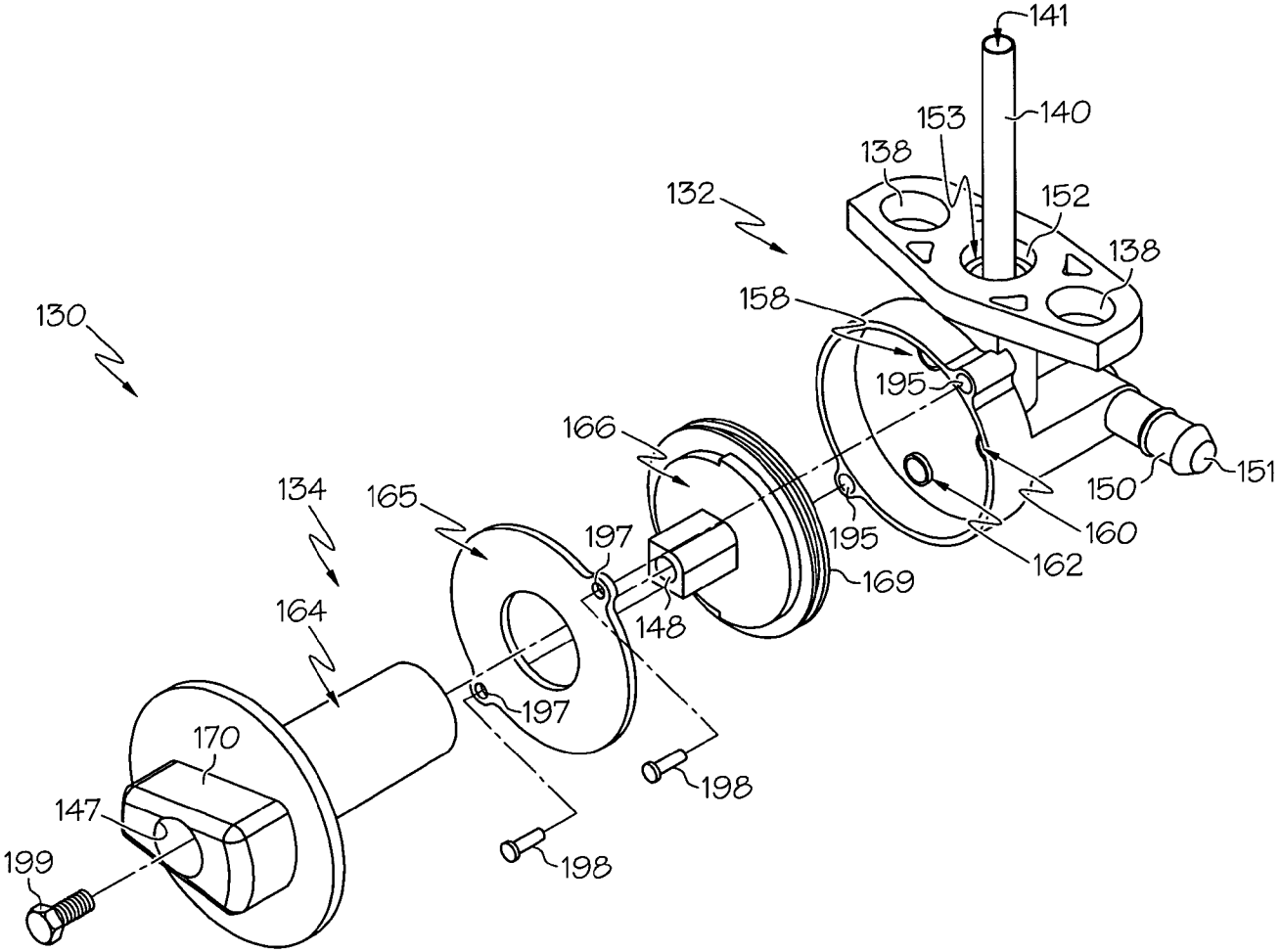
FIG. 9A (PRIOR ART)
FIG. 9A is a front perspective view depicting a conventional control device as being partially disassembled.
Figure 9C:
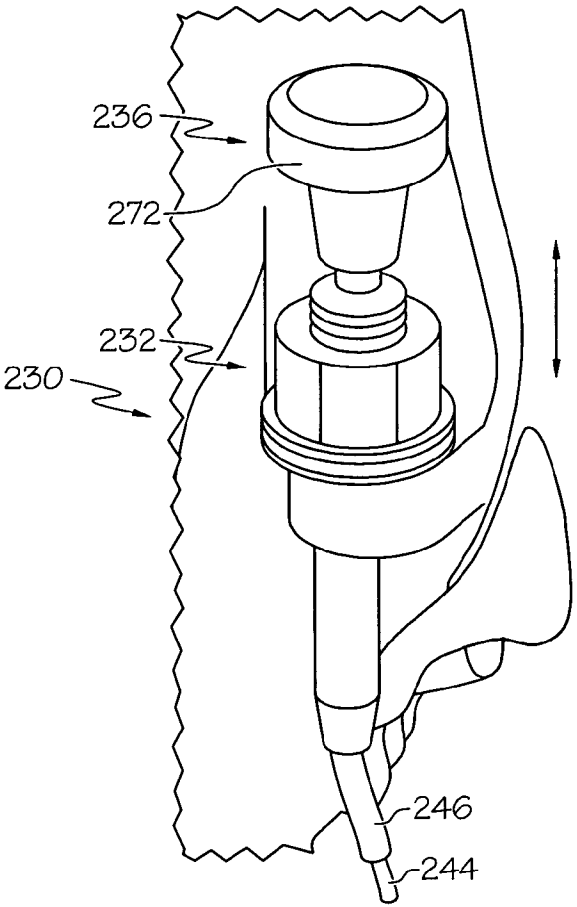
FIG. 9C (PRIOR ART)
FIG. 9C is a perspective view depicting another conventional control device.
Figure 9B:
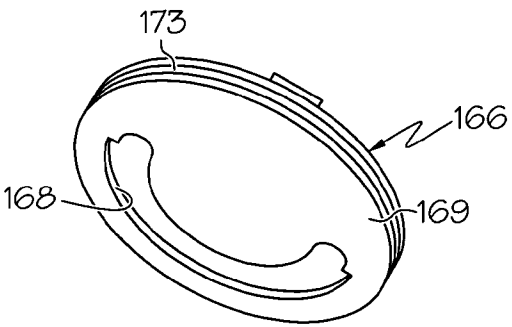
FIG. 9B (PRIOR ART)
FIG. 9B is a rear perspective view depicting a portion of the first knob of the control device of FIG. 9A.

In accordance with one embodiment of the present invention, the base 32 of the control device 30 cooperates with the first knob 34 to selectively define a conduit to facilitate the flow of fuel from the fuel tank 22 to the engine 15. The provision of this conduit will now be explained with reference to FIGS. 6-7 and 8A-8F. As shown in FIG. 7, the bottom surface 69 of the valve member 66 of the first knob 34 can be substantially flat except that it can include the aperture 48 and a channel 68. The aperture 48 can be centrally located and can be configured for receiving the end portion 37 of the second knob 36 and/or the flexible cable 44. In one particular embodiment, the channel 68 can comprise an indentation into the bottom surface 69 of the valve member 66 of the first knob 34, whereby the channel 68 moves in correspondence with rotation of the first knob 34 about axis A (e.g., as shown in FIGS. 8B, 8D, and 8F).

The base 32 of the control device 30 can be provided with passageways to facilitate the selective flow of fuel. For example, as shown in FIG. 7, the base 32 is shown to comprise passageways 58, 60 and 62. Referring also to FIGS. 2-3, the passageway 58 can be connected with a passageway 53 defined by an opening 52 in the base 32 of the control device 30, and can be configured to receive fuel 80 through the passageway 96 in the bottom wall 29 of the fuel tank 22. The passageway 60 can be connected with the passageway 51 in the outlet port 50 of the base 32 for provision of fuel 80 from the control device 30 to the engine 15. The passageway 62 can be coupled with the passageway 41 defined by the inlet tube 40 for receiving fuel 80 from the non-reserve portion 84 of the fuel tank 22. The base 32 is also shown to include an aperture 56 to facilitate the passage of the end portion 37 of the second knob 36 and/or the flexible cable 44 attached to the end portion 37 of the second knob 36.

FIG. 8B depicts the relative positioning of the channel 68 with respect to the passageways 58, 60 and 62 in the base 32 during such time as when the first knob 34 is in the first position (shown in FIG. 8A) in accordance with one embodiment of the present invention. In this configuration, no portion of the channel 68 is shown to be positioned to overlap any of the passageways 58, 60 or 62, and each of the passageways 58, 60 and 62 is accordingly blocked by the bottom surface 69 of the valve member 66, thereby substantially preventing fuel from flowing from the fuel tank 22 to the engine 15 through the control device 30. However, it will be appreciated that, in other embodiments of the invention, the control device 30 may prevent the flow of fuel 80 from the fuel tank 22 to the engine 15 while the first knob 34 is in a first position in which the channel 68 partially or completely overlaps one or both of the passageways 58 and 62, but does not even partially overlap the passageway 60. In still another alternative embodiment, the control device 30 may prevent the flow of fuel 80 from the fuel tank 22 to the engine 15 while the first knob 34 is in a first position in which the channel 68 partially or completely overlaps the passageway 60, but does not even partially overlap either of the passageways 58, 62.

FIG. 8D depicts relative placement between the channel 68 and the valve member 66 with respect to the passageways 58, 60 and 62 in the base 32 when the first knob 34 is in the second position (shown in FIG. 8C) in accordance with one embodiment of the present invention. In particular, the channel 68 is shown to be positionally located over both passageways 60 and 62, thereby facilitating the flow of fuel 80 from the fuel tank 22 and to the engine 15 along pathways F as indicated in FIG. 8D. However, it will be appreciated that, while the first knob 34 is in the second position, if the level of fuel 80 within the non-reserve portion 84 of the chamber 86 is depleted, fuel from the reserve portion 82 of the chamber 86 will only be directed to the engine 15 by the control device 30 when the first knob 34 is rotated into the third position, as shown in FIG. 8E.

FIG. 8F depicts relative positioning of the channel 68 in the valve member 66 with respect to the passageways 58, 60 and 62 in the base 32 when the first knob 34 is in the third position (shown in FIG. 8E) in accordance with one embodiment of the present invention. When in the third position, the channel 68 can be positioned atop both of the passageways 58 and 60, thereby allowing fuel to flow from the reserve portion 82 of the fuel tank 22 and to the engine 15, as shown by arrows F in FIG. 8F. However, it will be appreciated that, while the first knob 34 is in the third position, fuel from the non-reserve portion 84 of the chamber 86 may also be directed to the engine 15 by the control device 30 as shown by arrows F in FIG. 8F.

It will be appreciated that a first knob of a control device in accordance with alternative embodiments of the present invention can be movable between only two positions, or alternatively among greater than three positions. It will also be appreciated that any of a variety of specific mechanical arrangements can be used to provide a valve relationship between the first knob and the base of the control device. In still other embodiments of the present invention, the first knob might rotationally interact with the base not to control the flow of fluid, but rather to facilitate engagement or disengagement of electrical contacts and/or movement of some mechanical linkage or cable. Likewise, in another embodiment of the present invention, the second knob might axially interact with the base not to facilitate axial movement of a cable, but rather to facilitate engagement or disengagement of electrical contacts, control of a fluid, and/or movement of some alternative mechanical linkage.

The manner in which certain components of the control device 30 may be assembled will now be described with reference to FIG. 5. The valve member 66 of the first knob 34 can first be positioned adjacent to the base 32 such that the bottom surface 69 of the valve member 66 is adjacent to some portion of the base 32. A cover 65 can then be attached to the base 32, such as with bolts 98 inserted through apertures 97 in the cover 65 and into threaded apertures 95 in the base 32, and such that a stem 71 of the valve member 66 extends through an opening 67 in the cover 65. In this configuration, it will be appreciated that the cover 65 substantially prevents axial movement of the valve member 66 with respect to the base 32, but allows for rotational movement of the valve member 66 with respect to the base 32. In other embodiments, the cover 65 can be attached to the base 32 with adhesives and/or with fasteners other than bolts. In still other embodiments, no such cover may be provided, and the valve member 66 can be axially restrained with respect to the base 32 through use of a ring-type clip, snap ring, or some other arrangement. It will be appreciated that one or more seals (e.g., O-rings) may be provided between the valve member 66 and the base 32 and/or the cover 65 to prevent escape of fuel. For example, in one particular embodiment, an O-ring (not shown) might be provided to interface a channel 73 disposed about the periphery of the valve member 66 of the first knob 34 to provide a seal with respect to the base 32. The base 32 and/or cover 65 may also include one or more ridges and/or other mechanical features for interacting with the valve member 66 or other portion of the first knob 34 to limit the range of rotation of the first knob 34 with respect to the base 32.

Figure 5:
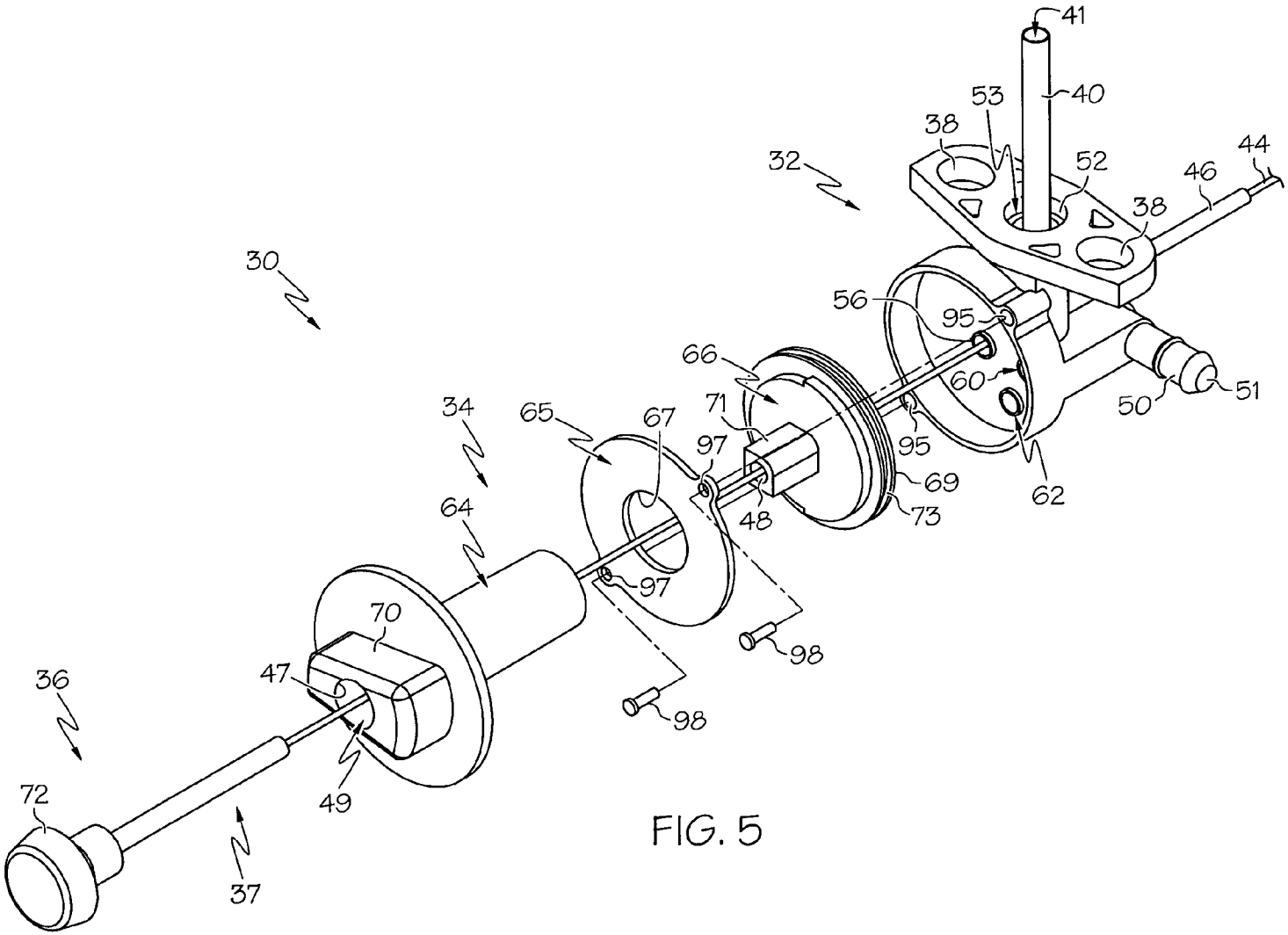
FIG. 5 is a front perspective view depicting the control device of FIGS. 3-4 as being partially disassembled.

In the embodiment of FIG. 5, once the cover 65 is attached to the base 32, the knob member 64 of the first knob 34 can be attached to the valve member 66 of the first knob 34. This attachment can, in one embodiment, involve insertion of the stem 71 of the valve member 66 into a corresponding aperture (not shown) in the knob member 64. A locking mechanical arrangement can be provided to secure this attachment between the valve member 66 and the knob member 64 of the first knob 32, although fasteners and/or adhesives may alternatively or additionally be provided to facilitate this attachment. The flexible cable 44 can then be threaded through the apertures 47, 48, and 56 such that the end portion 37 of the second knob 36 can be received within the passageway 49.

Any of a variety of retention devices or arrangements may be provided to limit the range of axial displacement of the second knob 36 with respect to the first knob 34 and the base 32. In one embodiment, such a retention device may be provided within the control device, although no such arrangement is depicted in FIG. 5. In another embodiment, such a retention device may be provided external to the control device. For example, a choke control within the engine 15 can have travel limits and can accordingly impose axial travel limits upon the second knob 36 by way of the flexible cable 44, and can accordingly serve as a retention arrangement for the second knob 36.

The foregoing description of embodiments and examples of the invention has been presented for purposes of illustration and description. It is not intended to be exhaustive or limit the invention to the forms described. Numerous modifications are possible in light of the above teachings. Some of those modifications have been discussed, and others will be understood by those skilled in the art. The embodiments were chosen and described in order to best illustrate the principles of the invention and various embodiments as are suited to the particular use contemplated. It is hereby intended that the scope of the invention be defined by the claims appended hereto.

What is claimed is:

1. A control device configured for use with an engine of a power equipment apparatus, the control device comprising:

a base;

a first knob positioned adjacent to the base and rotatable about an axis with respect to the base while being substantially restrained from axial movement along the axis with respect to the base, wherein the first knob comprises an aperture surrounding and extending along the axis to define a passageway extending through the first knob, and the first knob is configured to selectively facilitate the flow of fuel to an engine; and a second knob having an end portion slidingly received within the aperture of the first knob such that the second knob is axially movable along the axis with respect to the base and the first knob, wherein the second knob is operable to selectively facilitate choking of the engine.

2. The control device of claim 1 wherein the first knob is rotatable between a first position and a second position, the control device is configured to prohibit the flow of fuel to an engine when the first knob is in the first position, and the control device is configured to facilitate the flow of fuel from a first fuel source to an engine when the first knob is in the second position.

3. The control device of claim 2 wherein the first knob is additionally rotatable to a third position, and the control device is configured to facilitate the flow of fuel from a second fuel source to an engine when the first knob is in the third position.

4. The control device of claim 2 wherein the base cooperates with the first knob to selectively define a conduit to facilitate the flow of fuel to an engine.

5. The control device of claim 2 further comprising a flexible cable attached to the end portion of the second knob.

6. The control device of claim 3 wherein the base cooperates with the first knob to selectively define a conduit to facilitate the flow of fuel to an engine.

7. The control device of claim 3 further comprising a flexible cable attached to the end portion of the second knob.

8. The control device of claim 1 wherein the first knob comprises a first grip portion having a first outer diameter, the second knob comprises a second grip portion having a second outer diameter, and the first outer diameter is larger than the second outer diameter.

9. A power equipment apparatus comprising:

an engine;

a fuel tank; and a control device comprising a base, a first knob, and a second knob, wherein the first knob is positioned adjacent to the base and is rotatable about an axis with respect to the base while being substantially restrained from axial movement along the axis with respect to the base, and wherein the first knob comprises an aperture surrounding and extending along the axis to define a passageway extending through the first knob, the second knob has an end portion slidingly received within the aperture of the first knob such that the second knob is axially movable along the axis with respect to the base and the first knob, and the control device is coupled with each of the fuel tank and the engine such that the first knob is configured to selectively facilitate the flow of fuel from the fuel tank to the engine and such that the second knob is operable to selectively facilitate choking of the engine.

10. The power equipment apparatus of claim 9 wherein the first knob is rotatable between a first position and a second position, the control device is configured to prohibit the flow of fuel from the fuel tank to the engine when the first knob is in the first position, and the control device is configured to facilitate the flow of fuel from the fuel tank to the engine when the first knob is in the second position.

11. The power equipment apparatus of claim 10 wherein the fuel tank has a reserve portion and the first knob is additionally rotatable to a third position, and the control device is configured to facilitate the flow of fuel from the reserve portion of the fuel tank to the engine when the first knob is in the third position.

12. The power equipment apparatus of claim 10 wherein the base cooperates with the first knob to selectively define a conduit to facilitate the flow of fuel to an engine.

13. The power equipment apparatus of claim 10 further comprising a flexible cable attached to the end portion of the second knob.

14. A saddle-type vehicle comprising:

a frame;

a seat supported with respect to the frame and configured to support an operator in use of the saddle-type vehicle;

a handlebar supported with respect to the frame and configured to facilitate steering of the saddle-type vehicle by an operator; and a control device supported with respect to the frame and comprising a base, a first knob, and a second knob, wherein the first knob is positioned adjacent to the base and is rotatable about an axis with respect to the base while being substantially restrained from axial movement along the axis with respect to the base, the first knob comprises an aperture surrounding and extending along the axis to define a passageway extending through the first knob, and the second knob has an end portion slidingly received within the aperture of the first knob such that the second knob is axially movable along the axis with respect to the base and the first knob.

15. The saddle-type vehicle of claim 14 further comprising a fuel tank and an engine, wherein the control device is coupled with each of the fuel tank and the engine such that the first knob is configured to selectively facilitate the flow of fuel from the fuel tank to the engine, and such that the second knob is operable to selectively facilitate choking of the engine.

16. The saddle-type vehicle of claim 15 wherein the first knob is rotatable between a first position and a second position, the control device is configured to prohibit the flow of fuel from the fuel tank to the engine when the first knob is in the first position, and the control device is configured to facilitate the flow of fuel from the fuel tank to the engine when the first knob is in the second position.

17. The saddle-type vehicle of claim 14 comprising an all terrain vehicle.

18. The saddle-type vehicle of claim 16 wherein the base cooperates with the first knob to selectively define a conduit to facilitate the flow of fuel to an engine.

19. The saddle-type vehicle of claim 16 further comprising a flexible cable attached to the end portion of the second knob.

20. The saddle-type vehicle of claim 16 wherein the fuel tank has a reserve portion and the first knob is additionally rotatable to a third position, and the control device is configured to facilitate the flow of fuel from the reserve portion of the fuel tank to the engine when the first knob is in the third position.

21. The saddle-type vehicle of claim 20 further comprising:

a first body panel; and a second body panel; wherein the fuel tank is disposed beneath the first body panel;

the control device protrudes beyond the second body panel; and the saddle-type vehicle comprises an all terrain vehicle.

* * * * *